US009301668B2

(12) United States Patent
Lee et al.

(10) Patent No.: US 9,301,668 B2
(45) Date of Patent: Apr. 5, 2016

(54) DISHWASHER AND CONTROL METHOD THEREFOR

(71) Applicant: LG Electronics Inc., Seoul (KR)

(72) Inventors: Sanghoon Lee, Seoul (KR); Jongmin Lee, Seoul (KR); Kiyoung Kang, Seoul (KR); Minhan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 462 days.

(21) Appl. No.: 13/628,227

(22) Filed: Sep. 27, 2012

(65) Prior Publication Data

US 2013/0139854 A1 Jun. 6, 2013

(30) Foreign Application Priority Data

Sep. 27, 2011 (KR) ..... 10-2011-0097731

(51) Int. Cl.

| | |
|---|---|
| ***A47L 15/46*** | (2006.01) |
| ***A47L 15/20*** | (2006.01) |
| ***A47L 15/18*** | (2006.01) |
| ***A47L 15/00*** | (2006.01) |
| ***A47L 15/22*** | (2006.01) |
| *B08B 3/02* | (2006.01) |
| *B08B 3/00* | (2006.01) |
| *A47L 15/42* | (2006.01) |

(52) U.S. Cl.

CPC ..... *A47L 15/46* (2013.01); *A47L 15/0018* (2013.01); *A47L 15/18* (2013.01); *A47L 15/22* (2013.01); *A47L 15/4221* (2013.01); *A47L 15/4282* (2013.01); *A47L 15/4293* (2013.01); *A47L 2301/08* (2013.01); *A47L 2501/20* (2013.01); *B08B 3/00* (2013.01); *B08B 3/02* (2013.01)

(58) Field of Classification Search

CPC ..... A47L 15/0018; A47L 15/16; A47L 15/18; A47L 15/22; A47L 15/4295; A47L 2501/04; A47L 2402/04; A47L 2401/04; B08B 3/00; B08B 3/02

USPC ..... 134/10, 18, 25.2, 42, 56 D, 57 D, 58 D

See application file for complete search history.

(56) References Cited

U.S. PATENT DOCUMENTS

| | | | | |
|---|---|---|---|---|
| 3,095,885 | A | 7/1963 | Wilhelm | |
| 7,935,194 | B2 * | 5/2011 | Rolek | 134/56 D |

(Continued)

FOREIGN PATENT DOCUMENTS

| | | |
|---|---|---|
| DE | 10 2011 050 951 A1 | 2/2012 |
| JP | 2598942 | 6/1999 |

(Continued)

OTHER PUBLICATIONS

German Office Action issued Jun. 11, 2013 in German Patent Application No. 10 2012 217 568.7, including English translation, 6 pages.

(Continued)

*Primary Examiner* — Saeed T Chaudhry

(74) *Attorney, Agent, or Firm* — Fish & Richardson P.C.

(57) ABSTRACT

A dishwasher capable of efficiently washing dishes is provided. A dishwasher includes a washing tub, a rack, an area input unit and a spray module. The washing tub forms a space in which dishes are washed. The rack has the dishes loaded thereto, being provided inside the washing tub. The area input unit receives an area selected from a plurality of areas into which the rack is divided. The spray module sprays washing water toward the selected area input to the area input unit in the plurality of areas of the rack.

17 Claims, 4 Drawing Sheets

(56) References Cited

U.S. PATENT DOCUMENTS

| | | | | |
|---|---|---|---|---|
| 2005/0011544 | A1 | 1/2005 | Rosenbauer et al. | |
| 2007/0157920 | A1 * | 7/2007 | De Miranda Grieco | 126/211 |
| 2009/0071508 | A1 * | 3/2009 | Sundaram et al. | 134/18 |
| 2012/0031432 | A1 * | 2/2012 | Beaudet et al. | 134/18 |

FOREIGN PATENT DOCUMENTS

| | | | |
|---|---|---|---|
| KR | 10-2006-0124294 | A | 5/2006 |
| KR | 10-2006-0106026 | A | 10/2006 |
| KR | 1020060106026 | * | 12/2006 |
| KR | 10-2007-0014734 | A | 2/2007 |
| KR | 10-2010-0046571 | A | 5/2010 |

OTHER PUBLICATIONS

Korean Office Action issued Jun. 28, 2013 in Korean Patent Application No. 10-2011-0097731, including English translation, 8 pages.

PCT International Search Report dated Jan. 29, 2013 for Application No. PCT/KR2012/007764, 3 pages.

* cited by examiner

DISHWASHER AND CONTROL METHOD THEREFOR

BACKGROUND OF THE INVENTION

1. Field of the Invention

The present invention relates to a dishwasher and a control method therefor. More specifically, the present invention relates to a dishwasher and a control method therefor capable of efficiently washing dishes.

2. Description of the Conventional Art

In general, a dishwasher is an electric home appliance that washes food wastes adhering to surfaces of dishes by spraying high pressure washing water to the dishes through spray nozzles.

The dishwasher includes a washing tub and a sump in which washing water is stored, being disposed in a lower part of the washing tub. The washing water is moved to a spray module by the pumping operation of a washing pump disposed inside the sump, and the washing water moved to the spray module is sprayed with high pressure through spray nozzles formed at end parts of the spray module. Then, the washing water collides with surfaces of dishes, and contaminants such as food wastes adhering to the dishes fall on the bottom of the washing tub.

The dishwasher is provided with a rack to which dishes are loaded. The spray module sprays the washing water regardless of the number or position of dishes loaded to the rack, and therefore, time and water are wasted.

SUMMARY OF THE INVENTION

The invention has been made in an effort to provide a dishwasher and a control method therefor capable of efficiently washing dishes.

It is to be understood that technical problems to be solved by the present invention are not limited to the aforementioned technical problems and other technical problems which are not mentioned will be apparent from the following description to the person with an ordinary skill in the art to which the present invention pertains.

A dishwasher according to the present invention includes a washing tub forming a space in which dishes are washed; a rack to which the dishes are loaded, being provided inside the washing tub; an area input unit receiving an area selected from a plurality of areas into which the rack is divided; and a spray module spraying washing water toward the selected area input to the area input unit in the plurality of areas of the rack.

Also, a dishwasher according to the present invention includes a washing tub forming a space in which dishes are washed; a rack to which the dishes are loaded, being provided inside the washing tub; and a spray module spraying the washing water toward an area in which the dishes are disposed in the rack.

In a control method for a dishwasher according to the present invention including a washing tub forming a space in which dishes are washed and a rack to which the dishes are loaded, being provided inside the washing tub, the method includes receiving an area selected from a plurality of areas into which the rack is divided; and spraying washing water toward the selected area input to the area input unit in the plurality of areas of the rack.

Detailed items of other embodiments are included in detailed description and drawings.

DETAILED DESCRIPTION OF THE PREFERRED INVENTION

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
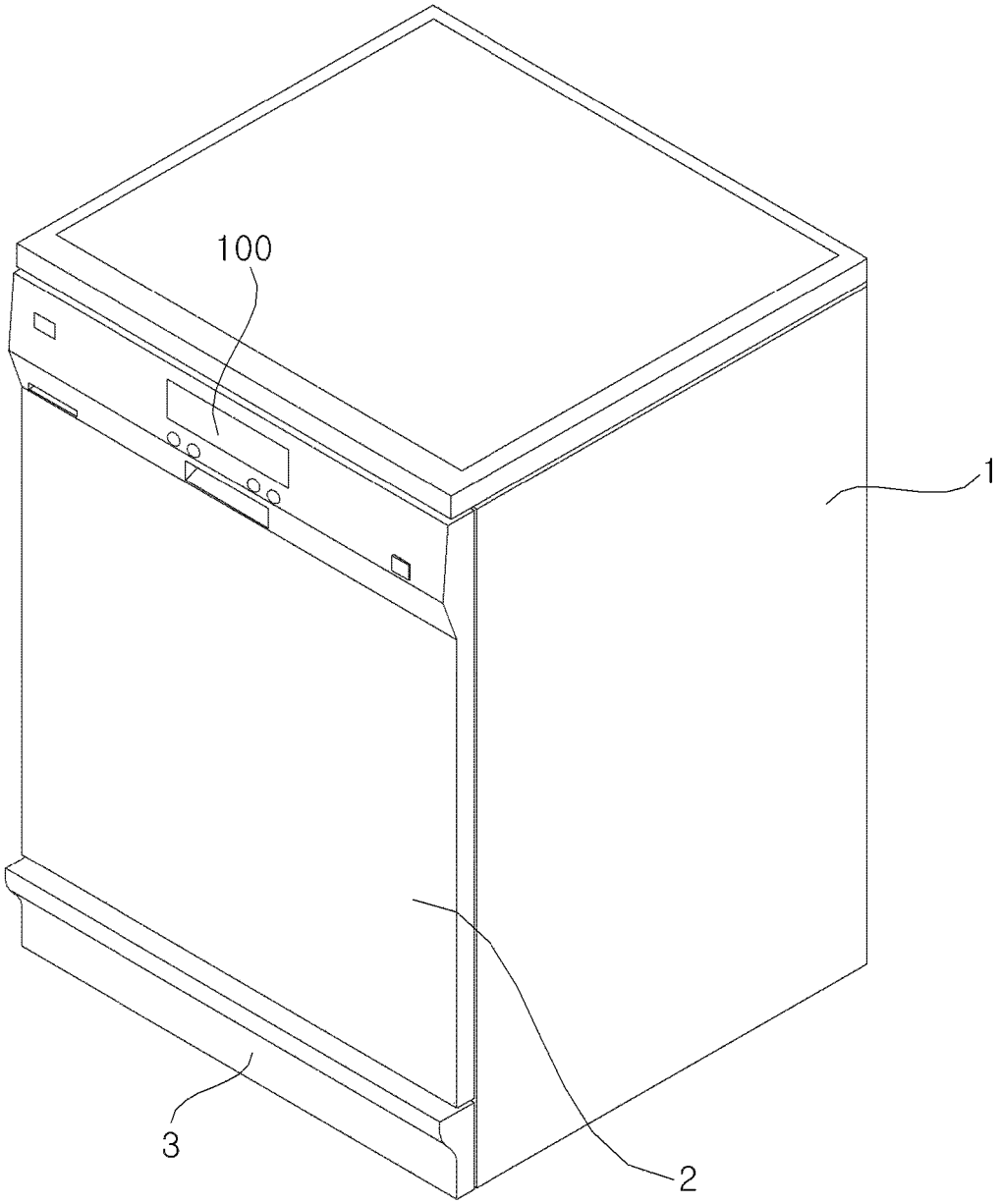
FIG. 1 is a perspective view of a dishwasher according to an embodiment of the present invention.
Figure 2:
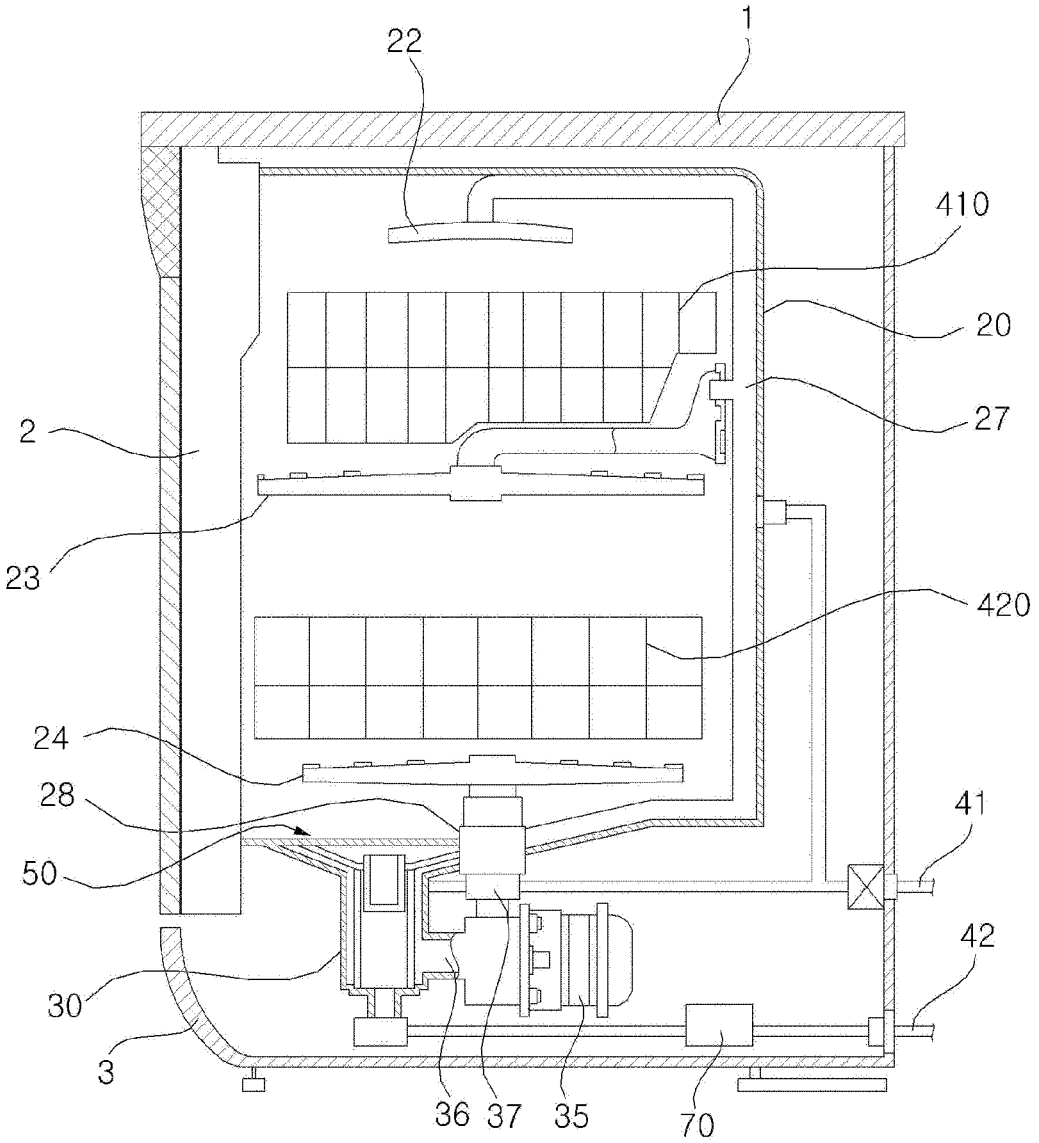
FIG. 2 is a sectional view of the dishwasher shown in FIG. 1.

FIG. 1 is a perspective view of a dishwasher according to an embodiment of the present invention. FIG. 2 is a sectional view of the dishwasher shown in FIG. 1.

The dishwasher according to the embodiment of the present invention includes a washing tub 20 forming a space in which dishes are washed, a rack 410 and 420 to which the dishes are loaded, and a spray module 22, 23 and 24 spraying washing water toward the dishes.

The case 1 forms the exterior of the dishwasher and provides a frame in which parts of the dishwasher are loaded. The case 1 has a front opened, and a user loads dishes inside the case 1 through the front.

The case 1 is provided with the washing tub 20 forming the space in which the dishes are washed therein. The dishes are washed in the washing tub 20. Like the case 1, the washing tub 20 has a front opened, so that the user loads the dishes inside the washing tub 20 through the opened front of the case 1.

A door 2 opens/closes the front of the case 1, and the washing tub 20 is made airtight by the door 2 while the dishes are washed inside the washing tub 20. The door 2 is rotatably coupled to the case 1, so that the front of the case 1 can be opened/closed.

A control panel 100 through which the user input a command is provided at an upper part of the front of the door 2. The control panel 100 displays an operation state of the dishwasher.

A lower cover 3 is provided at the front of the case 1. The lower cover 3 is provided below the door 2.

A sump 30 collecting washing water sprayed into the washing tub 20 is provided at a lower part of the washing tub 20. A filter assembly 50 filtering foreign matters in washing water flowed into the sump 30 is mounted in the sump 30.

The rack 410 and 420 having the dishes loaded thereto is provided inside the washing tub 20. In the embodiment of the present invention, the rack 410 and 420 includes an upper rack 410 and a lower rack 420. The upper rack 410 is provided at an upper part of the washing tub 20, and the lower rack 420 is provided at a lower part of the washing tub 20, which is disposed below the upper rack 410.

The spray module 22, 23 and 24 spraying the washing water are provided inside the washing tub 20. The spray module 22, 23 and 24 is formed in a rod shape to spray the washing water, being rotated about the center thereof. The spray module 22, 23 and 24 includes an upper spray module 22 spraying the washing water toward the upper rack 410, being provided above the upper rack 410, a lower spray module 24 spraying the washing water toward the lower rack 420, being provided below the lower rack 420, and a middle spray module 23 spraying the washing water toward the upper and lower racks 410 and 420, being provided between the upper and lower racks 410 and 420.

An upper flow path 27 and a lower flow path 28 are provided inside the washing tub 20 so that the washing water collected into the sump 30 is supplied to the upper, middle and lower spray modules 22, 23 and 24.

The washing tub 20 is provided with a water supply flow path 41 through which water from an external water source connected to the washing tub 20 is supplied to the inside of the washing tub 20, and a drainage flow path 42 through which contaminated washing water is drained to the outside of the dishwasher.

A drainage pump 70 for draining the washing water collected into the sump 30 to the outside of the dishwasher is provided on the drainage flow path 42. The drainage flow path 42 is preferably formed of a damping member capable of absorbing vibration, such as rubber or flexible pipe.

A washing pump 35 for supplying the washing water collected into the sump 30 to the upper, middle and lower modules 22, 23 and 24 is provided at a lower part of the washing tub 20. A suction pipe 36 connects the sump 30 to the washing pump 35, and a discharge pipe 37 connects the washing pump 35 to the upper and lower flow paths 27 and 28.

Figure 3:
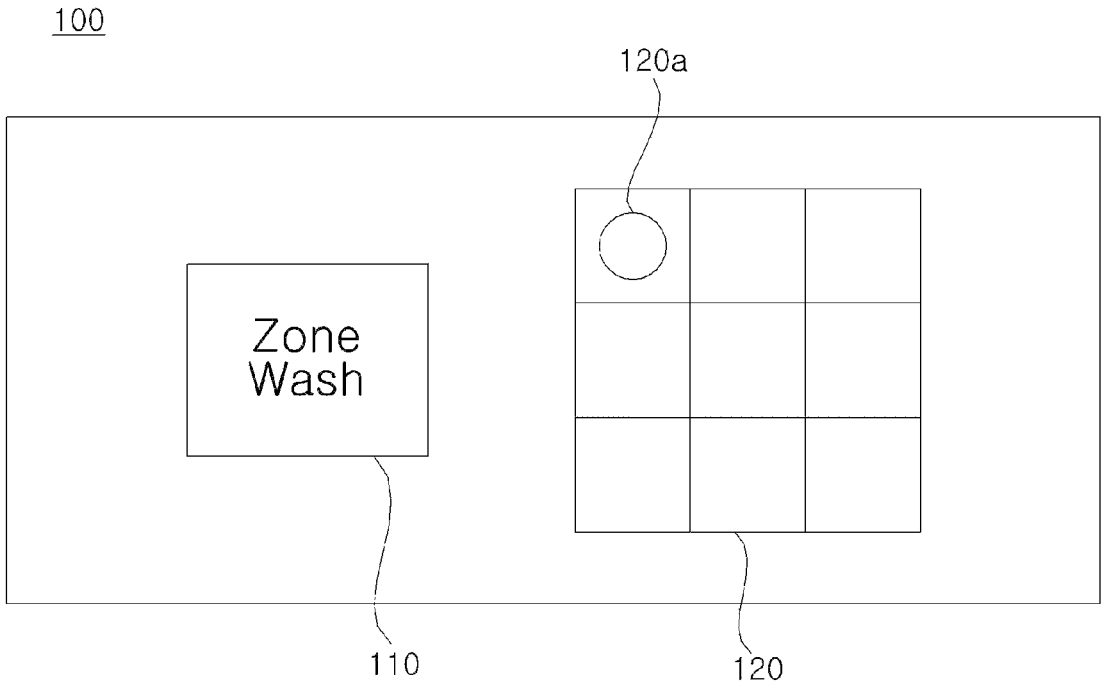
FIG. 3 is a view illustrating a portion of a control panel in the dishwasher according to an embodiment of the present invention.

FIG. 3 is a view illustrating a portion of a control panel in the dishwasher according to an embodiment of the present invention.

The control panel 100 includes an area input unit 120 divided into a plurality of areas so that the user selects one of the plurality of areas, and an area washing button 110 allowing the selected area to be concentratedly washed. Here, the areas are formed by dividing the bottom surface of the rack 410 and 420, on which dishes are disposed. That is, the areas are formed by vertically dividing a horizontal plane of the rack 410 and 420. The area input unit 120 may be provided with a plurality of area input units so that the user can select an area for each of the upper and lower racks 410 and 420.

The area input unit 120 receives an area 120*a* selected by a user. If the user touches the area input unit 120 to select an area, the selected area 120*a* is displayed in the area input unit 120. The user preferably selects the area in which dishes are disposed. The user may select a plurality of areas, and all the selected areas 120*a* may be displayed in the area input unit 120.

According to the embodiment of the present invention, if the user presses the area washing button 110 and then selects an area in the area input unit 120, the selected area 120*a* is concentratedly washed.

Figure 4:
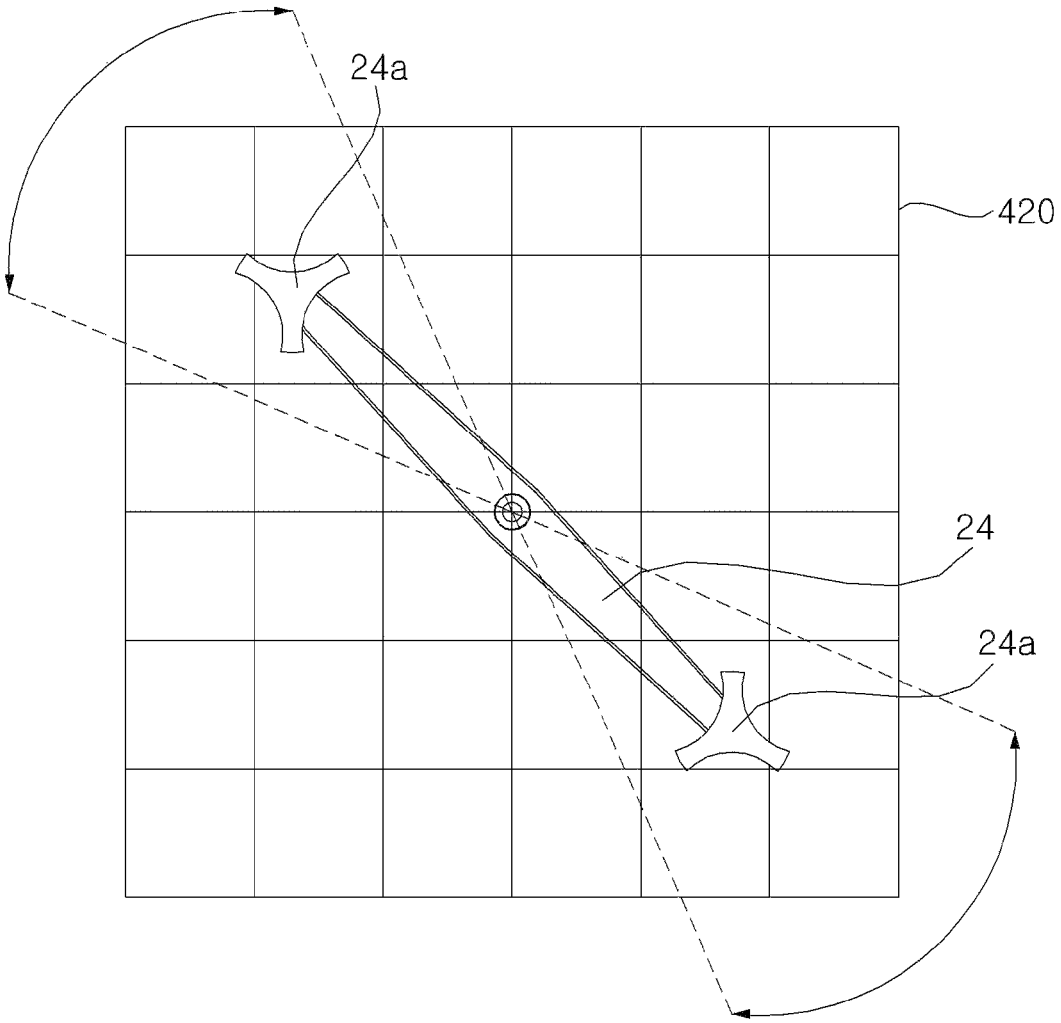
FIG. 4 is a view illustrating a method of washing an area in the dishwasher according to an embodiment of the present invention.

FIG. 4 is a view illustrating a method of washing an area in the dishwasher according to an embodiment of the present invention.

In the embodiment of the present invention, the lower spray module 24 in the spray module 22, 23 and 24 and the lower rack 420 in the rack 410 and 420 will be described as examples. According to the embodiment of the present invention, the spray module 22, 23 and 24 may be the upper or middle spray module 24 or 23, and the rack 410 and 420 may be the upper rack 410.

The lower spray module 24 is formed in a rod shape to spray the washing water, being rotated about the center thereof. Spray parts 24*a* rotating to spray washing water are provided at both ends of the lower spray module 24, respectively. The lower spray module 24 is preferably rotated by a servo motor (not shown) so that the rotation of the lower spray module 24 can be made at an exact position.

One of the plurality of areas in the lower rack 420 is selected through the area input unit 120. The lower spray module 24 locates the spray part 24*a* in the selected area 120*a* and spray the washing water. The selected area 120*a* is an area in which dishes are disposed, and the lower spray module 24 sprays the washing water toward the area in which the dishes are disposed in the lower rack 420. The lower spray module 24 can spray the washing water, being reciprocatively rotated to a predetermined angle about the selected area 120*a*.

According to the embodiment of the present invention, the lower spray module 24 can spray the washing water toward the area in which the dishes are disposed by automatically sensing the area in which the dishes are disposed. The lower spray module 24 may be provided with a sensor sensing the weight of dishes or a sensor such as a camera sensing the shapes of dishes in the washing tub 20. Thus, the lower spray module 24 can automatically sense the area in which the dishes are disposed in the lower rack 240. If the user presses the area washing button 110, the lower spray module 24 automatically senses the area in which the dishes are disposed and concentratedly sprays the washing water toward the corresponding area.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Such modified embodiments should not be understood as being separate from the technical spirit or scope of the present invention, but should be interpreted as being included in the accompanying claims of the present invention.

According to the dishwasher and the control method therefor of the present invention, one or more effects can be obtained as follows.

First, time and water can be saved by spraying the washing water toward the area in which dishes are disposed in the rack.

Second, the user can conveniently select the area in which dishes are disposed in the rack.

Third, the spray module can concentratedly and efficiently spray the washing water toward the area in which dishes are disposed, thereby improving washing performance.

The effects of the present invention are not limited to the above-described effects and other effects which are not described herein will become apparent to those skilled in the art from the accompanying claims.

What is claimed is:

1. A dishwasher, comprising:

a washing tub that defines a space in which dishes are washed;

a rack that is located inside the washing tub and is configured to hold the dishes;

an area input unit that includes an interface configured to display a representation of a plurality of areas into which the rack is divided and that is configured to receive, from a user, a selection of an area of the plurality of areas in the interface of the area input unit;

an area washing button that, based on being engaged, provides a signal for the selected area to be washed; and a spray module that is configured to spray a greater amount of washing water toward the selected area of the rack than to the plurality of areas other than the selected area, the spray module comprising:

a spray rod that has a rod shape and that is configured to rotate around a center of the spray rod;

a plurality of spray parts that are located at both ends of the spray rod and that are configured to spray washing water; and a motor configured to position at least one of the spray parts in the selected area by rotating the spray rod.

2. The dishwasher of claim 1, wherein the rack comprises an upper rack located at an upper part of the washing tub, and a lower rack located at a lower part of the washing tub.

3. The dishwasher of claim 2, wherein the spray module comprises:

an upper spray module that is configured to spray washing water toward the upper rack and located above the upper rack, a middle spray module that is configured to spray washing water toward the upper rack and the lower rack and located between the upper rack and the lower rack, and a lower spray module that is configured to spray washing water toward the lower rack and located below the lower rack.

4. The dishwasher of claim 1, wherein:

the washing tub has an open front, the dishwasher further comprises a door that is configured to open and close the open front of the washing tub, and the area input unit is located at an upper part of a front of the door.

5. The dishwasher of claim 1, wherein the spray rod is configured to reciprocate through a predetermined angle to spray washing water to the selected area.

6. The dishwasher of claim 1, wherein the spray module is configured to spray water only to the selected area.

7. The dishwasher of claim 1, wherein the spray module is configured to spray water only to the selected area and an area of the plurality of areas opposite a center of the spray module.

8. The dishwasher of claim 1, wherein the area washing button provides a signal for the selected area to be intensively washed.

9. The dishwasher of claim 1, wherein the selected area to be intensively washed is sprayed with a greater amount of water than the plurality of areas other than the selected area.

10. The dishwasher of claim 1, comprising a sensor that is configured to sense an area of the rack that is loaded with more dishes than other areas of the rack.

11. The dishwasher of claim 10, wherein the spray module is configured to spray a greater amount of washing water toward the area of the rack that is loaded with more dishes than the other areas of the rack.

12. The dishwasher of claim 10, wherein the sensor is configured to sense the area of the rack that is loaded with more dishes than the other areas of the rack by detecting a weight of the dishes in the rack.

13. The dishwasher of claim 1, wherein each spray part is configured to rotate independent of the spray rod.

14. The dishwasher of claim 13, wherein an axis of rotation of each spray part is parallel to an axis of rotation the spray rod.

15. The dishwasher of claim 1, wherein the area input unit is further configured to receive a selection of an additional area and display a representation of the selection of the area and the additional area within the representation of the plurality of areas.

16. The dishwasher of claim 1, wherein a geometric area of each of the plurality of areas into which the rack is about equal.

17. The dishwasher of claim 1, comprising a servomotor that is configured to rotate the spray module.

* * * * *